US009666992B2

(12) United States Patent
Cox

(10) Patent No.: US 9,666,992 B2
(45) Date of Patent: May 30, 2017

(54) VARIABLE ANGLE EMI SHIELDING ASSEMBLY

(71) Applicant: Molex, LLC, Lisle, IL (US)

(72) Inventor: Calvin Cox, Benton, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/780,636

(22) PCT Filed: Mar. 26, 2014

(86) PCT No.: PCT/US2014/031876
§ 371 (c)(1),
(2) Date: Sep. 28, 2015

(87) PCT Pub. No.: WO2014/160785
PCT Pub. Date: Oct. 2, 2014

(65) Prior Publication Data

US 2016/0056582 A1 Feb. 25, 2016

(51) Int. Cl.

| | |
|---|---|
| ***H01R 13/648*** | (2006.01) |
| ***H01R 13/6581*** | (2011.01) |
| ***H01R 13/58*** | (2006.01) |
| ***H01R 13/6593*** | (2011.01) |
| ***H01R 13/6595*** | (2011.01) |

(52) U.S. Cl.
CPC ..... *H01R 13/6581* (2013.01); *H01R 13/5841* (2013.01); *H01R 13/6593* (2013.01); *H01R 13/6595* (2013.01)

(58) Field of Classification Search
CPC ..... H01R 13/5841; H01R 13/6581; H01R 13/6595; H01R 13/6593
USPC ..... 439/607.01
See application file for complete search history.

(56) References Cited

U.S. PATENT DOCUMENTS

| | | | | |
|---|---|---|---|---|
| 4,892,491 | A * | 1/1990 | Budano, II | H01R 24/44 439/578 |
| 5,494,454 | A | 2/1996 | Johnsen | |
| 5,975,955 | A | 11/1999 | Bogiel et al. | |
| 6,287,147 | B1 | 9/2001 | Lin | |
| 6,811,422 | B1 * | 11/2004 | Muller | H01R 13/625 439/255 |

(Continued)

FOREIGN PATENT DOCUMENTS

| | | |
|---|---|---|
| JP | 04-119976 U | 10/1992 |
| KR | 20-0432916 Y1 | 12/2006 |

*Primary Examiner* — Javaid Nasri
(74) *Attorney, Agent, or Firm* — James A. O'Malley

(57) ABSTRACT

A conductive EMI shielding assembly for shielding the connection between a multi-wire cable and a corresponding circuit board connector is disclosed, and includes a housing portion for surrounding the circuit board connector and a coupling portion for mating with the housing portion and the cable. The housing portion has a base with a rectangular configuration and a collar portion that mates with a corresponding collar portion of the coupling portion. The coupling portion has an opposing end that slips over the end of the cable and attaches to the cable. The housing collar portion and coupling mating portion include associated tabs and openings arranged around them in a circular pattern at preselected angular intervals. The tabs and openings permit the coupling portion to be oriented with respect to the housing portion in a number of different patterns.

14 Claims, 5 Drawing Sheets

(56) References Cited

U.S. PATENT DOCUMENTS

| | | | |
|---|---|---|---|
| 7,938,683 | B2 | 5/2011 | Nagata |
| 2008/0003889 | A1 | 1/2008 | Link |
| 2008/0188119 | A1 | 8/2008 | Okamura et al. |

* cited by examiner

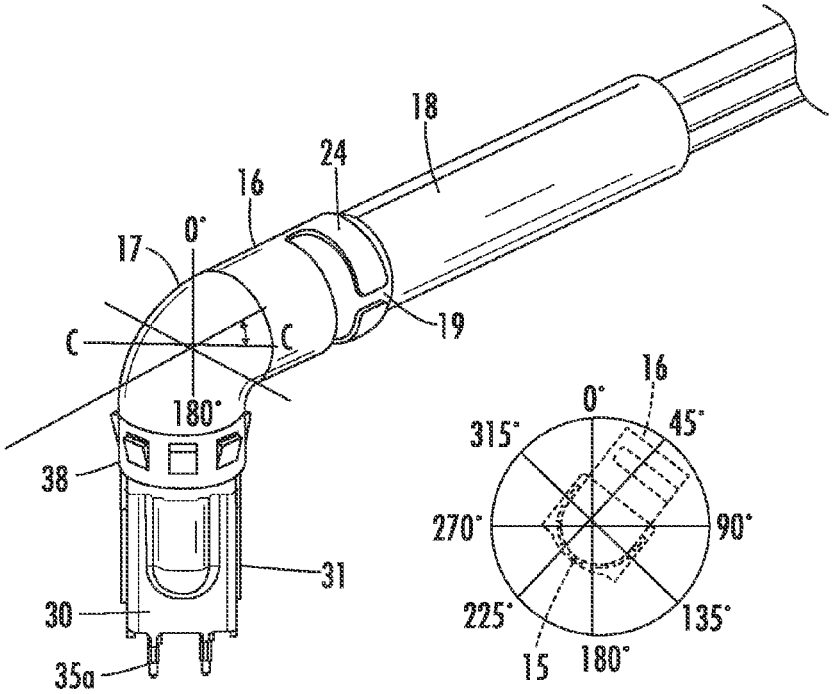
FIG. 3
FIG. 3A
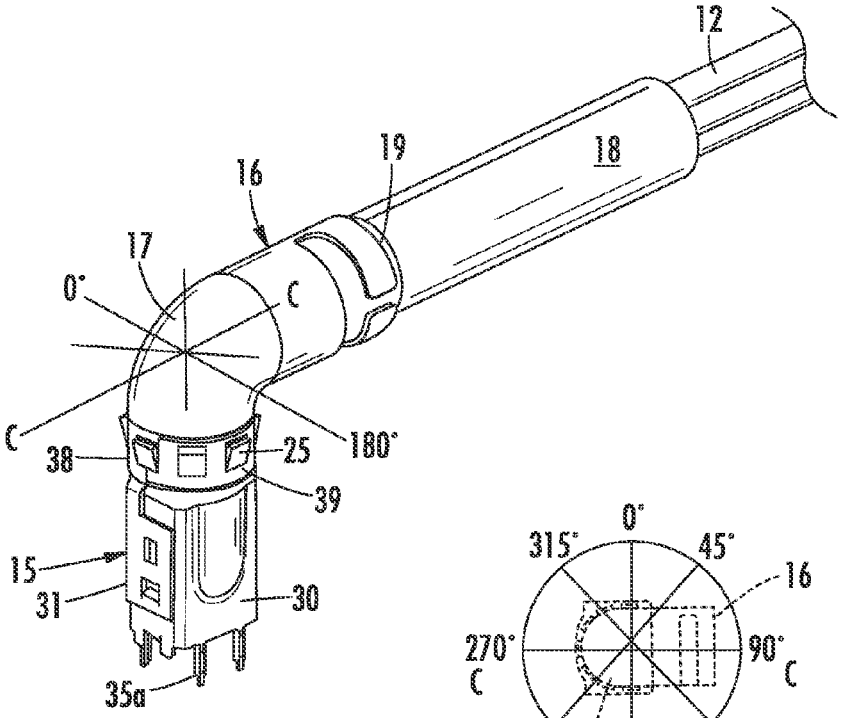
FIG. 4
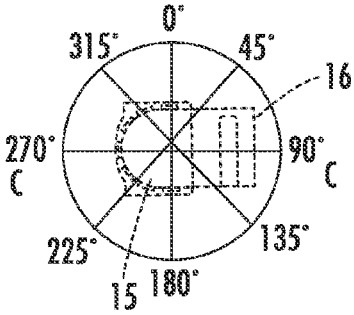
FIG. 4A

VARIABLE ANGLE EMI SHIELDING ASSEMBLY

CROSS REFERENCE TO RELATED APPLICATIONS

The Present Disclosure claims priority to prior-filed U.S. Provisional Patent Application No. 61/805,558, entitled "Variable Angle EMI Shielding Assembly," filed on 27 Mar. 2013 with the United States patent And Trademark Office. The content of the aforementioned Patent Application is fully incorporated in its entirety herein.

BACKGROUND OF THE PRESENT DISCLOSURE

The Present Disclosure relates generally to shielding assemblies, and, more particularly, to an improved shielding assembly that may be utilized in a variety of angular orientations.

In current electronic applications, shielded cables are utilized to bring multiple sets of wires into an electronic device. The wires are terminated to a connector or the like, and typically, an exterior shield must be provided that conductively interconnects the connector and the cable in a manner that will inhibit EMI. Many of these shields are fixed in their orientation, meaning that one part must be utilized for a cable exiting a connector at a first orientation, a second part must be used for a cable exiting a connector at a second orientation, a third part must be used for a cable exiting a connector at a third orientation, and so on. Multiple parts are needed for applications that require multiple exit aspects of the cables. This increases the cost of manufacture of the electronic device and adds additional labor.

The Present Disclosure is therefore directed to a shielding assembly having a multi-angle, or variable exit angular orientations, thereby eliminating the need for different parts and providing a cost savings to the manufacturer and facilitating installation of cables in shorter times.

SUMMARY OF THE PRESENT DISCLOSURE

Accordingly, there is provided a shielding assembly suitable for use with an electronic device and configured for mounting to a circuit board, and further configured for mating to a cable, the shielding assembly being capable of a plurality of different orientations in order to accommodate a plurality of distinct cable exit paths.

In accordance with the Present Disclosure, a multi-piece shielding assembly is provided. The assembly includes two distinct portions. One is a housing portion configured to surround a connector, preferably of the wire to board type. The housing portion provides a conductive shield that surrounds the connector, while the other distinct portion is a coupling portion that provides a hollow conductive member that surrounds the termination area of the cable and which mates with the housing portion in a fixed angular orientation.

In order to provide the installer with the ability to install the cable in a plurality of different angular exit aspects with respect to the shielding assembly housing portion, the coupling portion is provided with a plurality of raised members that preferably take the form of tabs, that may be punched or otherwise formed, as part of the coupling portion. These tabs project slightly from the coupling portions and may include one or more hard edges. Corresponding openings are formed in a collar of the housing portion and these openings receive the tabs in a manner so that the tab is captured within the opening. The tabs and opening are spaced at a preselected angular arrangement around the both the housing portion collar and the coupling portions, such as at 45° increments, so that the coupling portion may be easily rotated with respect to the housing portion and be angularly offset therefrom at 45° increments. The angular spacing chosen between the tabs may be different, such as 60°, 90° or the like. As such, the installer may easily orient the coupling portion and cable it surrounds at a variety of orientations.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 3 is the same view as FIG. 1, but with the housing portion thereof rotated 45°;

FIG. 3A is a circle plot of the angular orientation of the shielding assembly of FIG. 3, taken from above, illustrating the angular orientation of the coupling portion with respect to the housing portion;

FIG. 4 is the same view as FIG. 1, but with the housing portion thereof rotated 90°;

FIG. 4A is a circle plot of the angular orientation of the shielding assembly of FIG. 3, taken from above, illustrating the angular orientation of the coupling portion with respect to the housing portion;

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
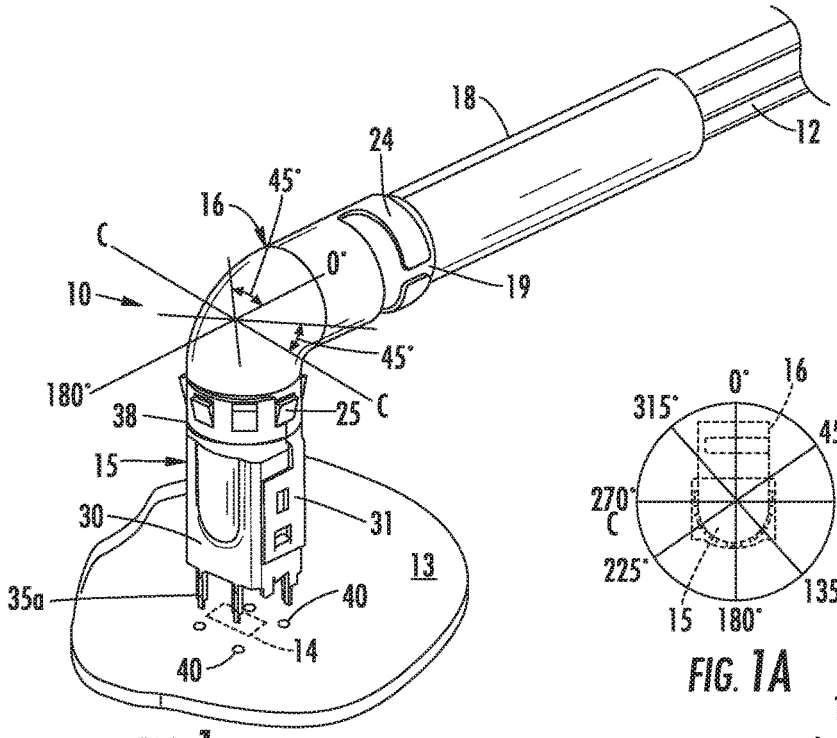
FIG. 1 is a perspective view of a shielding assembly constructed in accordance with the Present Disclosure.
Figure 1A:
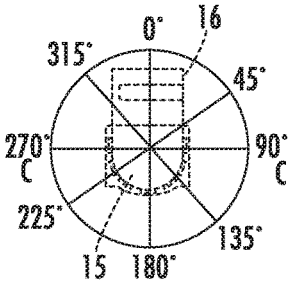
FIG. 1A is a circle plot of the angular orientation of the shielding assembly of FIG. 1, taken from above, illustrating the angular orientation of the coupling portion with respect to the housing portion.

FIG. 1 is a perspective view of a shielding assembly 10 used in an electronic device, constructed in accordance with the Present Disclosure. The shielding assembly 10 is configured to provide a conductive grounding shield for a high-speed cable 18 containing a plurality of wires 12 connected to a connector 14 (shown in phantom) mounted on a circuit board 13 in order to connect the wires 12 of the cable 18 to circuits on the circuit board 13. The shielding assembly 10 provides a conductive enclosure for the cable and its connection to the cable which prevents electromagnetic interference (EMI) from leaking out during operation of the electronic device. In this regard, the shielding assembly is provided with mounting members, shown in the embodiment of FIGS. 1-4, as compliant pins 35*a* received within corresponding opposing mounting holes 40 formed in the circuit board 13. The shielding assembly 10 provides an enclosure that envelops, or surrounds, the connector 14 and the area where the conductors 13 of the wires 12 are terminated to terminals of the connector. This enclosure extends from the upper surface of the circuit board 13 to a location on the cable where the cable internal grounding shield 19 is exposed, and so provides a seal against EMI leakage within the electronic device.

Figure 2:
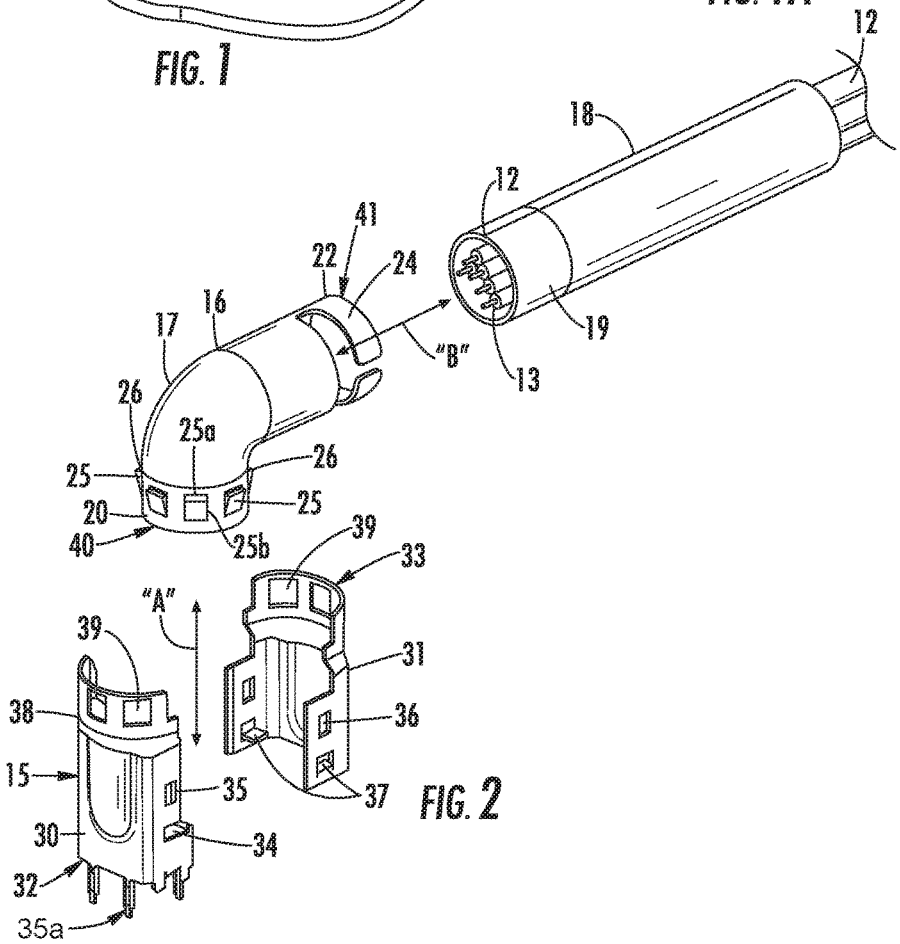
FIG. 2 is an exploded view of the shielding assembly of FIG. 1.

Turning to FIG. 2, it can be seen that the shielding assembly 10 includes two complementary-shaped interengaging components 15, 16. One is referred to herein as a housing portion 15 because it surrounds, or houses, the connector 14. As such, it preferably is formed from two halves 31, 32, which cooperatively define a hollow rectangular configuration with four sidewalk as shown. Mounting members, namely compliant pins 35*a* or solid lugs 35*b*, are arranged in a pattern around the perimeter of the interior connector 14. These pins 35*a* are formed along a mounting end of the housing portion 15 and they extend outwardly (and downwardly) from the housing portion halves 31, 32. When assembled, the housing portion 15 defines a hollow, conductive enclosure that has a central axis "A" (FIG. 2) and which is connected to ground circuits of the circuit board 13. The housing portion 15 may further include one or more contact members, shown as contact arms 37, which are bent inwardly and extend into the hollow enclosure defined by the housing halves 31, 32 in a manner so as to make electrical grounding contact with the connector 14 disposed therein. Engagement openings 36 may be formed on one of the housing portion halves 31, and these openings 36 slip over and engage corresponding tabs 35 that are formed in the other housing half portion 32.

In order to provide a means for connecting the shielding assembly 10 to the cable 18, the housing portion 15 includes a mating end 33 disposed opposite from the mounting end 32. This mating end 33 has a different configuration than the remainder of the housing portion 15. In FIGS. 1-2, it can be seen that the mating end 33 has a circular, or tubular configuration, with a collar portion 38 that extends in a complete circular (360°) extent at the mating end 33 of the housing portion 15. This transition from a rectangular configuration to a circular configuration gives the shielding assembly of the Present Disclosure the ability to mate with the coupling portion 16 in different angular orientations.

The other shielding assembly component is referred to herein as a coupling portion 16, configured as a hollow tabular element that includes at least one change of direction. In other words, the coupling portion 16 has a hollow interior with one end, a mating plug end 40, aligned with the housing portion 15 along its central axis A. The coupling portion 16 includes a bend 17 to give it a traditional pipe "elbow" configuration as illustrated. The other end, a cable mounting end 41, is not only oriented at an angle from the opposing, mating end 40 of the coupling portion 16, but it also has its own central axis "B" (FIG. 2) angularly offset from the axis A of the housing portion 15. The mating plug end 40 of the coupling portion 16 is also circularly configured to mate with the mating end 33 of the housing portion 15. This circular configuration enables the selective orientation of the coupling portion 16 on the housing portion 15.

The cable 18 will normally enter the electronic device from a variety of directions. Thus, it is beneficial for an assembler of the device to have the capability of surrounding the mating interface between the connector 14 and cable 18 with a shielding assembly that can accommodate a plurality of different angular orientations of the cable 18 so that the connector 14 and its associated housing portion 15 do not have to be mounted to the circuit board 13 in a particular position. Rather, any position will suffice, thereby giving the designer greater freedom. In order to accomplish this, the shielding assembly of the Present Disclosure has a plurality of engagement members on both components 15, 16 arranged to engage each other in a plurality of orientations. The coupling portion 16 has, on its mating plug end 40, a plurality of outwardly extending engagement members, illustrated as tabs 25, formed by pressing a U-shaped slot 36 through the sidewall thereof. The housing portion collar portion 38 has its openings 39 arranged thereon in a preselected pattern, and in the Figures, the openings are arranged at 45 degree intervals. Although illustrated in FIGS. 1-4 as the mating plug end 40 fitting within the housing portion mating end collar 38, it will be understood that the collar may be formed on the coupling portion mating end to fit over a similarly configured housing portion mating end collar.

In this manner, the coupling portion 16 can be oriented at eight different positions (when viewed from above) with respect to the housing portion 15 around the plot superimposed on the coupling portion elbow in FIG. 1. The circle plots of FIGS. 1 and 3-4 illustrate the orientation of the coupling portion 16 with respect to the housing portion 15 of the shielding assembly. The bolded Line C-C in these Figures and in the circle plots serves as a point of reference to the viewer. Line C-C is a line that intersects the two sidewalk of the housing portion 15. In FIG. 1, the coupling portion 16 extends transversely, or at a 90-degree angle to Line C-C (shown in dashed line in the circle plot). In FIG. 3, the coupling portion 16 is oriented at a 45-degree angle from Line C-C, while in FIG. 4, the coupling portions 16 is aligned with Line C-C, or in line with the sidewalk of the housing portion.

Figure 6:
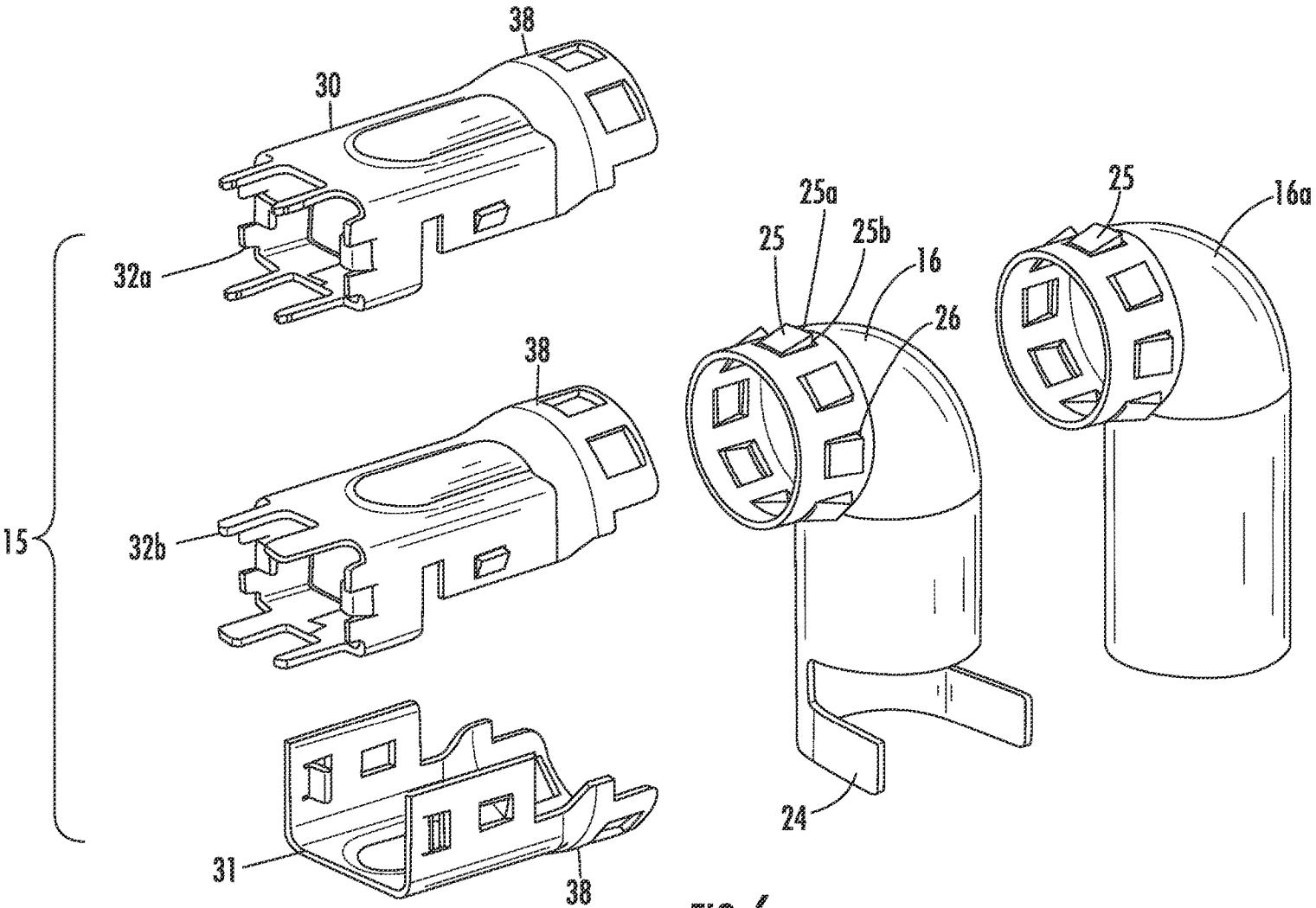
FIG. 6 is an exploded view of the shielding assembly of FIG. 5.
Figure 7:
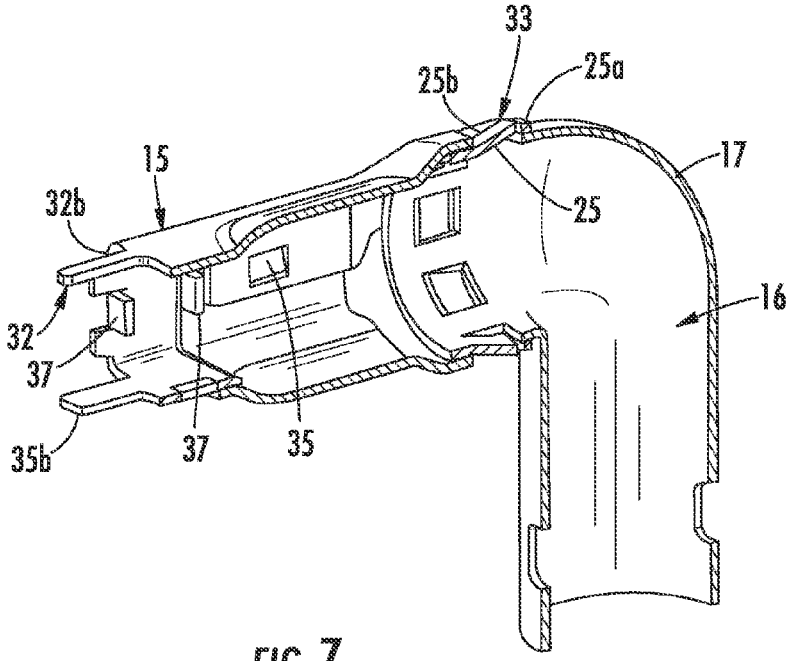
FIG. 7 is a sectional view taken through the shielding assembly of FIG. 5.
Figure 8:
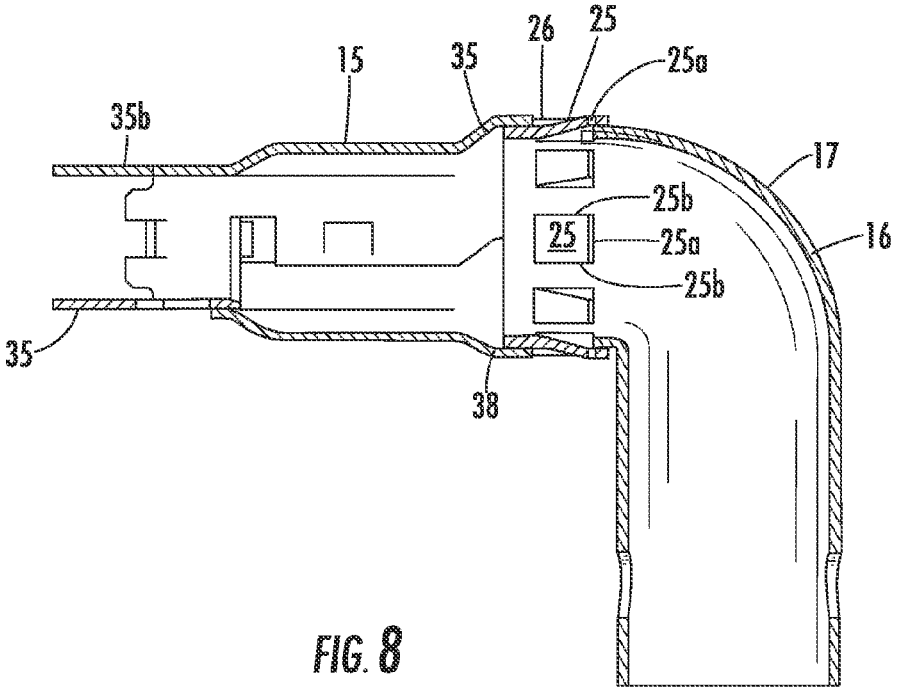
FIG. 8 is a side elevational view of the shielding assembly of FIG. 7.

The coupling portion tabs 25 are pressed out from the coupling portion at an angle directed downwardly so that the coupling portion 16 may be easily inserted into the housing portion collar 18. As the tabs 25 project at an angle, they define hard edges at their tops and sides 25*a*, 25*b*, and the hard edges on the sides prevent the coupling from being rotated with respect to the housing portion 15 and so that, preferably once the two portions are mated together, they stay together. The mounting end 41 of the coupling portion 16 may be provided with a crimping band 24 that can be crimped over the exterior of the cable 18, or the cable mounting end of the coupling portion 16*a* may be made solid so that it is suitable for welding or soldering to the cable, as shown in FIG. 6.

Figure 5:
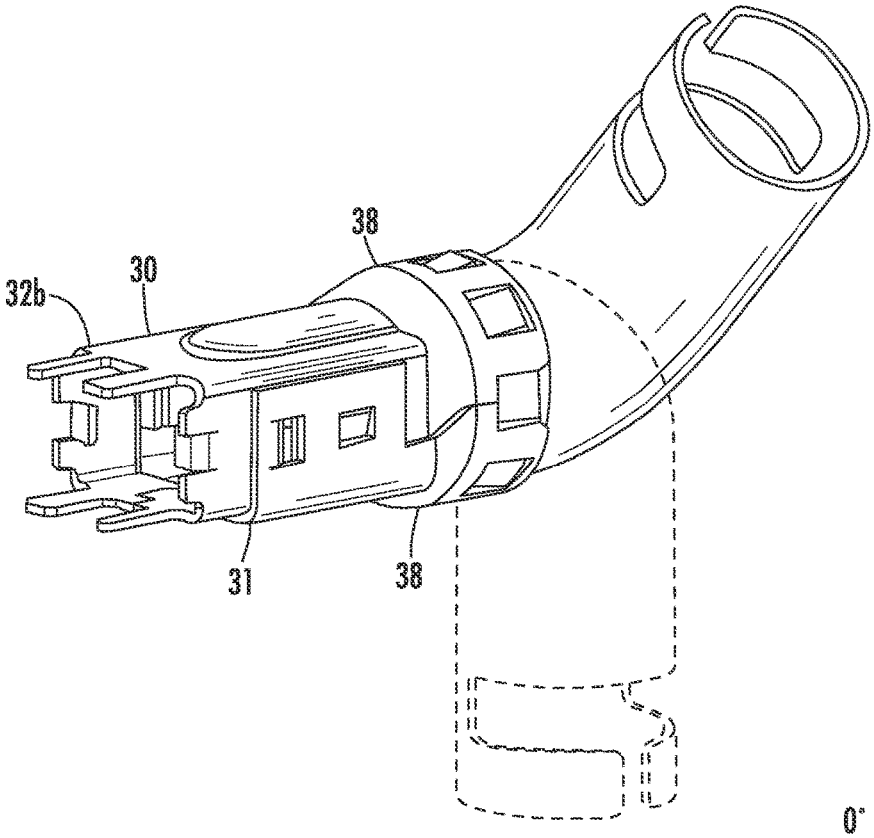
FIG. 5 is an enlarged view of the housing and coupling portions of the shielding assembly of FIG. 1.
Figure 5A:
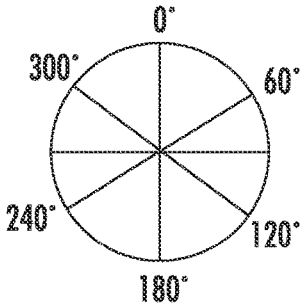
FIG. 5A is a circle plot of an angular orientation for use with the shielding assemblies of the Present Disclosure with a uniform 60° angular spacing between engagement elements.

Thus, the shielding assemblies 10 of the Present Disclosure permit the installer to easily mate the housing and coupling portions 15, 16 to accommodate multiple directions from which the cable may enter the electronic device without requiring special tools for installation nor an inventory of parts for each specific direction. Although the spacing interval has been shown as a uniform 45° spacing, alternate spacings may be chosen, such as 0°, 60°, 120°, 180°, 240°, 300° and 360°, as illustrated in FIG. 5A, or even an irregular spacing interval. The one housing portion half 32*b* may include solid mounting lugs rather than mounting pins as shown in FIG. 6.

While a preferred embodiment of the Present Disclosure is shown and described, it is envisioned that those skilled in the art may devise various modifications without departing from the spirit and scope of the foregoing Description and the appended Claims.

What is claimed is:

1. A shielding assembly configured to provide a conductive grounding shield for a cable containing a plurality of wires connected to a connector mounted on a circuit board in order to connect the wires of the cable to circuits on the circuit board, the shielding assembly comprising:

a housing portion having a mating end portion and a mounting end portion, the mating end portion of the housing portion having a first sidewall configuration and being configured to house the connector, the mounting end portion of the housing portion having a second sidewall configuration, wherein the first and second sidewall configurations are different, the mounting end portion of the housing portion having at least one mounting pin extending outwardly therefrom which is configured to be mounted to the circuit board, the housing portion having a central axis; and a coupling portion having a mating end portion, a mounting end portion and a bend provided between the mating and mounting end portions of the coupling portion, the mounting end portion of the coupling portion configured to receive the cable therein, wherein the mating end portions of the housing and coupling portions include interengaging elements that permit the coupling portion to be mated to the housing portion in one of a plurality of preselected orientations, and wherein the bend in the coupling portion causes the mounting end portion of the coupling portion to have a central axis which is angularly offset from the central axis of the housing portion.

2. The shielding assembly as defined in claim 1, wherein the first sidewall configuration is rectangular and the second sidewall configuration is circular.

3. The shielding assembly as defined in claim 1, wherein the housing portion is formed of first and second interengaging halves, the first interengaging half including engagement tabs disposed therein, the second interengaging half including engagement openings that receive the engagement tabs therein.

4. The shielding assembly as defined in claim 1, wherein the housing portion includes at least one contact arm which extends inwardly and which is configured to contact the connector.

5. The shielding assembly as defined in claim 4, wherein the housing portion includes a plurality of contact arms which extend inwardly and which are configured to contact the connector.

6. The shielding assembly as defined in claim 1, wherein the mating end portion of the housing portion includes a collar, and wherein the mating end portion of the coupling portion includes a plug end, the plug end configured to engage the collar.

7. The shielding assembly as defined in claim 6, wherein the plug end fits within the collar.

8. The shielding assembly as defined in claim 1, wherein the interengaging elements include a plurality of engagement tabs disposed on one of the mating end portions of the housing and coupling portions, and a plurality of engagement openings disposed in the other one of the mating end portions of the housing and coupling portions, the plurality of engagement openings configured to receive the plurality of engagement tabs therein.

9. The shielding assembly as defined in claim 8, wherein the engagement tabs and openings are disposed in a circular spacing around the mating end portions of the housing and coupling portions, and wherein adjacent engagement tabs are separated by intervening angular spacings, and wherein adjacent engagement openings are separated by intervening angular spacings.

10. The shielding assembly as defined in claim 9, wherein adjacement engagement tabs are spaced approximately 45 degrees apart from one another, and wherein the adjacement engagement openings are spaced approximately 45 degrees apart from one another.

11. The shielding assembly as defined in claim 9, wherein the adjacent engagement tabs are spaced approximately 90 degrees apart from one another, and wherein the adjacent engagement openings are spaced approximately 90 degrees apart from one another.

12. The shielding assembly as defined in claim 9, wherein the adjacent engagement tabs are spaced approximately 60 degrees apart from one another, and wherein the adjacent engagement openings are spaced approximately 60 degrees apart from one another.

13. The shielding assembly as defined in claim 9, wherein adjacent engagement tabs are spaced uniformly apart from one another, and wherein adjacent engagement openings are spaced uniformly apart from one another.

14. The shielding assembly as defined in claim 1, wherein the mounting end portion of the coupling portion includes a crimping band.

* * * * *